US007300387B2

(12) United States Patent
Wang

(10) Patent No.: US 7,300,387 B2
(45) Date of Patent: Nov. 27, 2007

(54) TREADLE ASSEMBLY OF AN EXERCISE EQUIPMENT

(76) Inventor: Leao Wang, No. 1, Lane 233, Sec. 2, Charng Long Rd., Taiping (TW) 411

( * ) Notice: Subject to any disclaimer, the term of this patent is extended or adjusted under 35 U.S.C. 154(b) by 27 days.

(21) Appl. No.: 11/296,621

(22) Filed: Dec. 8, 2005

(65) Prior Publication Data

US 2007/0135267 A1 Jun. 14, 2007

(51) Int. Cl.
*A63B 22/00* (2006.01)
*A63B 22/06* (2006.01)

(52) U.S. Cl. ..... 482/52; 482/70

(58) Field of Classification Search ..... 482/52, 482/51, 57, 70

See application file for complete search history.

(56) References Cited

U.S. PATENT DOCUMENTS 4,376,532 A * 3/1983 Hunstad ..... 482/71
4,457,084 A * 7/1984 Horibata et al. ..... 36/7.8
4,669,722 A * 6/1987 Rangaswamy ..... 482/79
5,449,332 A * 9/1995 Hervig ..... 482/57
5,690,589 A * 11/1997 Rodgers, Jr. ..... 482/57
6,277,055 B1 * 8/2001 Birrell et al. ..... 482/52
6,875,160 B2 * 4/2005 Watterson et al. ..... 482/57

* cited by examiner

*Primary Examiner*—Stephen R. Crow

(57) ABSTRACT

A treadle assembly of an exercise equipment including a mounting seat, a treadle, a bearing bracket. The mounting seat includes a supporting groove in the middle thereof and two indentations in the middle of both sides thereof. The treadle includes a rigid cylinder at the bottom thereof. The inside of the rigid cylinder is filled with soft filling material. A screw bolt is fitted in the middle of the soft filling material for securing the mounting seat to the treadle by fixing the screw bolt in the indentations of the mounting seat in collaboration with screwing elements. The bearing bracket is attached to a bottom side of the supporting groove of the mounting seat. Meanwhile, a bearing is disposed at each of four corners for a full contact with the periphery of the rigid cylinder. Thus, a plurality of connecting holes is formed at both sides of the mounting seat for securing the mounting seat to a treadle plank of an exercise equipment.

2 Claims, 2 Drawing Sheets

TREADLE ASSEMBLY OF AN EXERCISE EQUIPMENT

BACKGROUND OF THE INVENTION

1. Fields of the Invention

The invention relates to a treadle assembly of an exercise equipment, and more particularly to a treadle assembly that undergoes a proper angle change with the up and down movement of the treadle plank of the exercise equipment in adjustment to the soles of both feet of the operator for protecting his ankle joints from injuries.

2. Description of the Related Art

The soles of the feet of the operators are subject to a certain angle change with the up and down movement of the treadle plank of the exercise equipment when an operator takes exercise on a treadmill or an elliptical cross trainer. For example, the soles of the feet tend to be raised while they rise, and they tend to be downwardly inclined when they sink.

It's never seen that any means for adjusting the change of the treading angle is fitted to the treadle of the conventional exercise equipment. Therefore, the operator has to be forced to adjust himself to the angle change of the treadle. When the operator only uses the exercise equipment for a short time, the aforementioned design may not pose an injury risk to the operator. However, the ankle joints of the long-term operator would be subjected to exercise injuries due to the mechanic compulsory force caused by the unnatural positions for a long time. Most of the operators who do not realized the potential hazard would get unknown injuries in the area of the ankle joints in the future. If it's true, the manufacturers of the exercise equipment must be responsible for it.

SUMMARY OF THE INVENTION

Therefore, it is a primary object of the invention to provide a treadle assembly of an exercise equipment that protects the ankle joints of the long-term users from potential injuries, thereby achieving more safety in operation.

In order to achieve the above-mentioned object, a soft filling material like rubber with torsional and resilient elasticity is employed for subjecting the treadle to synchronic torsion due to application of force to the treadle, thereby resulting in proper angle change in adjustment of the soles of the operator's feet. Of course, the filling material brings the treadle in original position when the external force is removed. In this way, the ankle joints of the operator can be properly protected from injuries.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
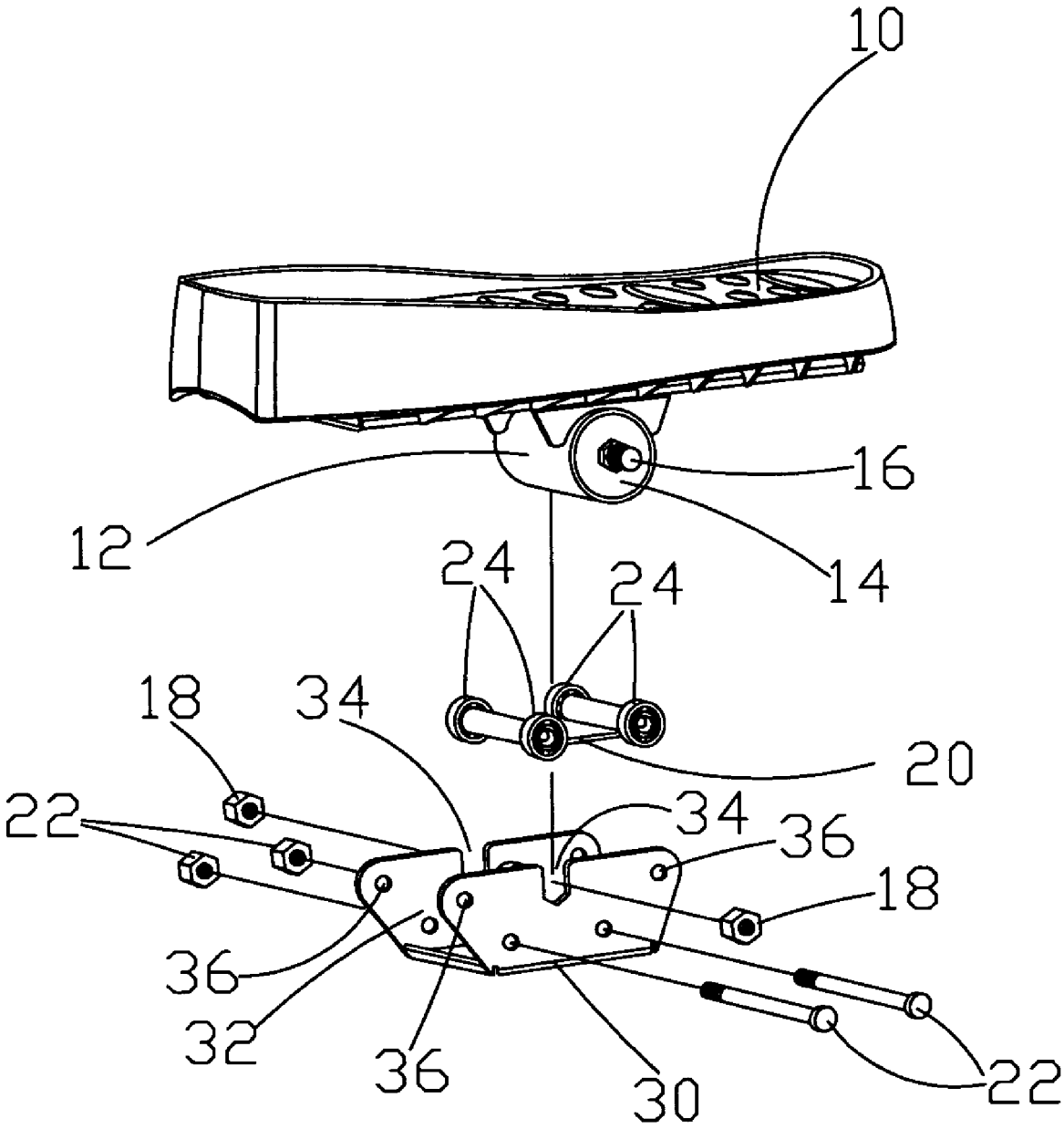
FIG. 1 is a perspective exploded view of the present invention.
Figure 2:
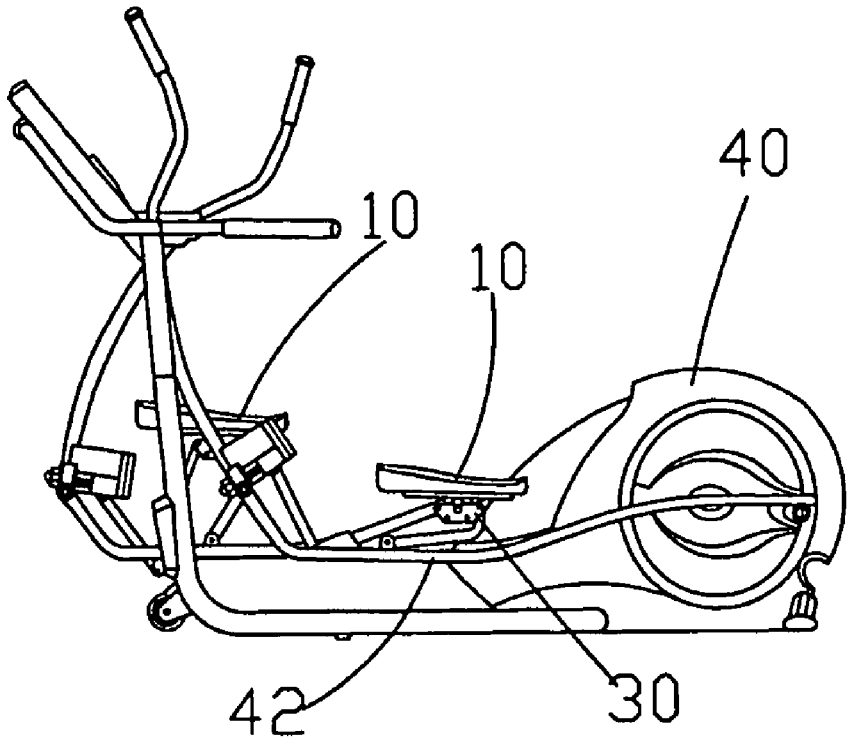
FIG. 2 is a schematic drawing of a preferred application of the invention.

First of all, referring to FIGS. 1 and 2, the invention includes a mounting seat 30, a treadle 10, a bearing bracket 20, The mounting seat 30 includes a supporting groove 32 in the middle thereof and two indentations 34 in the middle of both sides thereof.

The treadle 10 includes a rigid cylinder 12 at the bottom thereof. The inside of the rigid cylinder 12 is filled with soft filling material 14. A screw bolt 16 is fitted in the middle of the soft filling material 14 for securing the mounting seat 30 to the treadle 10 by fixing the screw bolt 16 in the indentations 34 of the mounting seat 30 in collaboration with screwing elements 18.

The bearing bracket 20 is attached to a bottom side of the supporting groove 32 of the mounting seat 30. Meanwhile, a bearing 24 is disposed at each of four corners for a full contact with the periphery of the rigid cylinder 12.

In addition, a plurality of connecting holes 36 are formed at both sides of the mounting seat 30 for securing the mounting seat 30 to a treadle plank 42 of an exercise equipment 40

Based on the assembly of the above-mentioned components, as shown in FIG. 2, the treadle 10 undergoes a proper angle change with the up and down movement of the treadle plank 42 of the exercise equipment 40 in adjustment to the soles of both feet of the operator for protecting his ankle joints from injuries.

Figure 3:
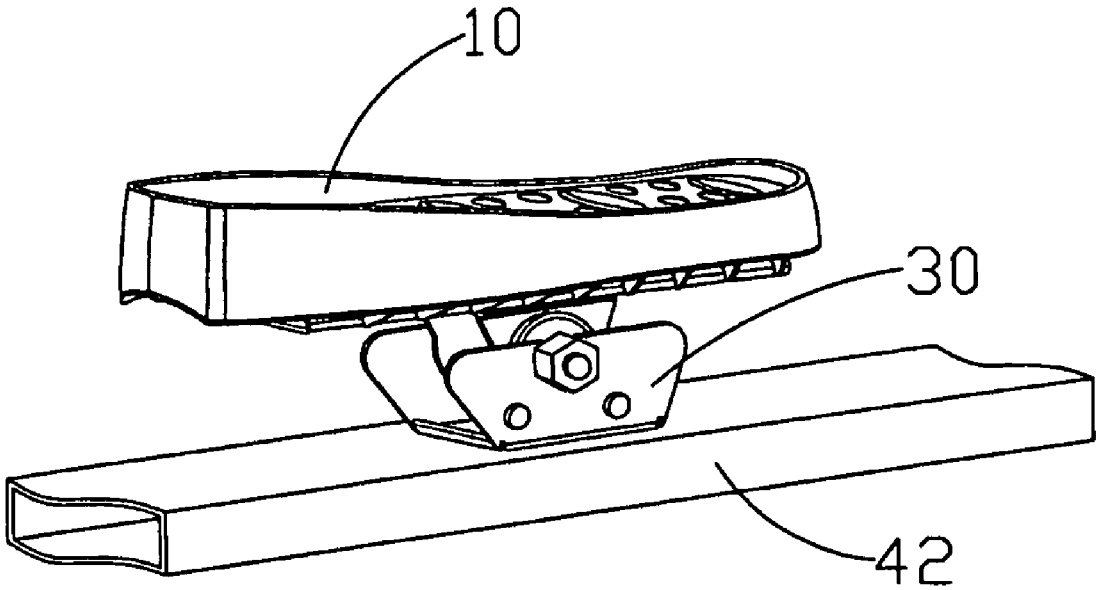
FIG. 3 is a schematic drawing of another preferred application of the invention.

As shown in FIG. 3, the mounting seat 30 may be directly screwed or welded to the surface of the treadle plank 42 for achieving the same safety effect in operation.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An elliptical exercise device having a treadle assembly, comprising:

a) a mounting seat having a supporting groove in the middle thereof and two indentations in the middle of both sides thereof;

b) a treadle having a rigid cylinder at the bottom thereof, the inside of the rigid cylinder being filled with soft filling material, a screw bolt being fitted in the middle of the soft filling material for securing the mounting seat to the treadle by fixing the screw bolt in the indentations of the mounting seat;

c) a bearing bracket attached to a bottom side of the supporting groove of the mounting seat, a bearing being disposed at each of four corners for a full contact with the periphery of the rigid, cylinder; and d) a treadle plank, the mounting seat is connected to the treadle pank, whereby, the soft filling material subjects the treadle to a torsion force, and whereby the treadle moves in an elliptical path during use.

2. The elliptical exercise device according to claim 1, wherein the mounting seat is directly fixed on the surface of the treadle plank.

* * * * *